US011162407B2

(12) United States Patent
Aiello

(10) Patent No.: US 11,162,407 B2
(45) Date of Patent: Nov. 2, 2021

(54) REPLACEMENT EXHAUST MANIFOLD FOR RETROFITTING A TURBOCHARGER TO AN ENGINE

(71) Applicant: Bostic Motors Inc., Bostic, NC (US)

(72) Inventor: Jeffrey Graham Aiello, Bostic, NC (US)

(73) Assignee: BOSTIC MOTORS INC., Bostic, NC (US)

( * ) Notice: Subject to any disclaimer, the term of this patent is extended or adjusted under 35 U.S.C. 154(b) by 24 days.

(21) Appl. No.: 16/801,345

(22) Filed: Feb. 26, 2020

(65) Prior Publication Data

US 2021/0262378 A1 Aug. 26, 2021

(51) Int. Cl.
*F01N 13/10* (2010.01)

(52) U.S. Cl.
CPC ..... *F01N 13/10* (2013.01)

(58) Field of Classification Search
CPC .... F01N 13/10; F01N 13/1805; F02B 37/183; F02B 75/22
See application file for complete search history.

(56) References Cited

U.S. PATENT DOCUMENTS 4,294,073 A * 10/1981 Neff ..... F02B 37/02 60/597
4,450,019 A * 5/1984 Satou ..... C22C 37/10 420/25
4,514,986 A * 5/1985 Benson ..... F02B 37/02 60/605.1
2015/0226106 A1* 8/2015 Murakami ..... F01N 13/1805 60/323
2019/0128175 A1* 5/2019 Tiramani ..... F02B 37/183

* cited by examiner

*Primary Examiner* — Phutthiwat Wongwian
*Assistant Examiner* — Diem T Tran
(74) *Attorney, Agent, or Firm* — Jeffrey C. Watson; Mathew L. Grell; Grell & Watson Patent Attorneys LLC

(57) ABSTRACT

A replacement exhaust manifold for retrofitting a turbocharger to an engine includes a central channel body, an exhaust connection, a turbo connection, and a plurality of exhaust ports. The central channel body has a first end and a second end. The exhaust connection is connected to the first end of the central channel body. The exhaust connection is configured to be attached to an exhaust system for the engine. The turbo connection is connected to the second end of the central channel body. The turbo connection is configured to be attached to the turbocharger. The plurality of exhaust ports are along the central channel body. Each of the exhaust ports are configured to be attached to a corresponding exhaust outlet port on a cylinder head of the engine. Wherein, the replacement exhaust manifold is configured to be attached to the engine for retrofitting the turbocharger to the engine.

19 Claims, 11 Drawing Sheets

REPLACEMENT EXHAUST MANIFOLD FOR RETROFITTING A TURBOCHARGER TO AN ENGINE

FIELD OF THE DISCLOSURE

The present disclosure is directed to exhaust manifolds for diesel engines. Namely the present disclosure is directed to a replacement exhaust manifold for a 6.2 and/or 6.5 non-turbo diesel engine, or the like. More specifically, the present disclosure is directed to a replacement right-hand side exhaust manifold configured for retrofitting a turbocharger on a 6.2 and/or 6.5 non-turbo diesel engine, or the like, for adding a turbocharger to such 6.2 and/or 6.5 non-turbo diesel engines installed in civilian and military high mobility multipurpose wheeled vehicles, or the like.

BACKGROUND

A turbocharger, colloquially known as a turbo, is a turbine-driven, forced induction device that increases an internal combustion engine's efficiency and power output by forcing extra compressed air into the combustion chamber. This improvement over a naturally aspirated engine's power output is due to the fact that the compressor can force more air, and proportionately more fuel, into the combustion chamber than atmospheric pressure alone. Turbochargers were originally known as turbosuperchargers when all forced induction devices were classified as superchargers. Today, the term "supercharger" is typically applied only to mechanically driven forced induction devices. The key difference between a turbocharger and a conventional supercharger is that a supercharger is mechanically driven by the engine, often through a belt connected to the crankshaft, whereas a turbocharger is powered by a turbine driven by the engine's exhaust gas. Compared with a mechanically driven supercharger, turbochargers tend to be more efficient, but less responsive.

Manufacturers commonly use turbochargers in truck, car, train, aircraft, and construction-equipment engines. They are most often used with Otto cycle and Diesel cycle internal combustion engines. The instant disclosure relates to retrofitting a non-turbo engine with a turbocharger. Namely, the instant disclosure relates to retrofitting a non-turbo diesel engine, like a 6.2 non-turbo diesel engine or a 6.5 non-turbo diesel engine, or the like with a turbocharger, like on civilian or military high mobility multipurpose wheeled vehicles. As an example, the instant disclosure of a replacement exhaust manifold may be installed in the AM General® HMMWV and Hummer H-1 chassis, as provided by AM General® of South Bend, Ind., that may include such 6.2 non-turbo diesel engines or 6.5 non-turbo diesel engines, or the like, for retrofitting such vehicles with a turbocharger.

Prior to the instant disclosure of a replacement exhaust manifold configured for retrofitting a turbocharger on the engine, any owner who wanted to add a turbocharger to their non-turbo engine either had to replace the engine, replace the engine cover and lift the truck body in order to retrofit the turbocharger to the engine, or combinations thereof. As such, retrofitting such non-turbo engines with a turbocharger was very labor intensive and thus expensive making it pretty rare or non-feasible for the owners to undertake. Therefore, there is clearly a need to provide a means, mechanism and/or method for allow a user to retrofit a turbocharger onto an engine that is less labor intensive and thus less expensive making it more feasible for the owner.

The instant disclosure may be designed to address at least certain aspects of the problems or needs discussed above by providing a replacement exhaust manifold for retrofitting a turbocharger to an engine.

SUMMARY

The present disclosure solves the aforementioned limitations of the currently available engines and means for retrofitting non-turbo engines, by providing a replacement exhaust manifold configured for retrofitting a turbocharger onto the non-turbo engine. The disclosed device, system or method may be configured for various engines, including diesel engines, like 6.2 non-turbo diesel engines, 6.5 non-turbo diesel engines, or the like, to allow for retrofitting of a turbocharger on such non-turbo engines. The vehicles retrofitted may be civilian or military high mobility multipurpose wheeled vehicles with such a 6.2 non-turbo diesel engine or a 6.5 non-turbo diesel engine. The disclosed replacement exhaust manifold for retrofitting a turbocharger to an engine may generally include a central channel body, an exhaust connection, a turbo connection, and a plurality of exhaust ports. The central channel body may have a first end and a second end. The exhaust connection may be connected to the first end of the central channel body. The exhaust connection may be configured to be attached to an exhaust system for the engine. The turbo connection may be connected to the second end of the central channel body. The turbo connection may be configured to be attached to the turbocharger. The plurality of exhaust ports may be along the central channel body. Each of the exhaust ports are configured to be attached to a corresponding exhaust outlet port on a cylinder head of the engine Wherein, the replacement exhaust manifold may be configured to be attached to the engine for retrofitting the turbocharger to the engine.

One feature of the disclosed replacement exhaust manifold may be that it can be configured to replace an original equipment exhaust manifold for retrofitting the turbocharger to the engine.

Another feature of the disclosed replacement exhaust manifold may be that it can be configured to retrofit a 6.2 non-turbo diesel engine or a 6.5 non-turbo diesel engine. The replacement exhaust manifold may be configured to be mounted on a right side cylinder head of the 6.2 non-turbo diesel engine or the 6.5 non-turbo diesel engine, like in a civilian or military high mobility multipurpose wheeled vehicles. Wherein the replacement exhaust manifold may be configured to work within tight confines of the under-hood area on the vehicle housing the engine. The replacement exhaust manifold may be designed to make acceptable clearance to all under-hood obstacles and allow the retrofitted turbocharger to function.

Another feature of the disclosed replacement exhaust manifold may be that it can be configured to facilitate the collection of all exhaust gases of the engine and route such exhaust gases through the turbo connection. This feature may result in an increase in power from the engine via the retrofitted turbocharger. The replacement exhaust manifold may receive the incoming exhaust gases and may channel them to the retrofitted turbocharger, thereby resulting in available boost and additional power for the engine.

Another feature of the disclosed replacement exhaust manifold may be that it can be configured to allow a self-contained bolt-on product to facilitate retrofitting the turbocharger to the engine.

Another feature of the disclosed replacement exhaust manifold may be that it can be configured to allow the engine to be retrofitted with the turbocharger without the need to replace the engine, replace the engine cover, lift a truck body in order for to retrofit the turbocharger to the engine, the like, or combinations thereof.

In select embodiments, the replacement exhaust manifold may be made of a cast ductile iron.

In select embodiments of the replacement exhaust manifold, the exhaust connection may be a triangular flange. The triangular flange may be configured to attach to the exhaust system of the engine. The triangular flange may include a circular channel with three exhaust holes therethrough at each triangle corner of the triangular flange. Whereby the triangular flange may be bolted to the exhaust system via three exhaust bolts where the circular channel is configured to be sealed to the exhaust system. In select embodiments, the exhaust connection may be connected to the first end of the central channel body via an S-shaped connection. The S-shaped connection may be configured to lower the exhaust connection below the central channel body. In select embodiments, an exhaust end port of one of the plurality of exhaust ports may be positioned along the S-shaped connection.

In other select embodiments of the disclosed replacement exhaust manifold, the plurality of exhaust ports may include four exhaust ports. With this configuration, one exhaust port may be for each of the four exhaust outlet ports in the right-hand side cylinder head of a 6.2 non-turbo diesel engine or a 6.5 non-turbo diesel engine on civilian or military high mobility multipurpose wheeled vehicles, like as installed in AM General® (Military) HMMWV trucks and/or AM General® civilian specification H-1 model trucks, as provided by AM General® of South Bend, Ind.

In other select embodiments of the disclosed replacement exhaust manifold, each of the exhaust ports may include a diamond shaped flange. The diamond shaped flange may be configured to attach to one of the corresponding exhaust outlet ports in the right-hand side cylinder head of the engine. Each of the exhaust ports may include a curved rectangular channel protruding from the central channel body and terminating with the diamond shaped flange. Each of the diamond shaped flanges may include a first notch at one diamond corner and a second notch at an opposite diamond corner. Whereby, each of the diamond shaped flanges may be bolted to one of the corresponding exhaust outlet ports of the right-hand side cylinder head of the engine via two cylinder bolts, one cylinder bolt through the first notch and another cylinder bolt through the second notch. Wherein, each of the rectangular channels of the exhaust ports may be sealed to one of the corresponding exhaust outlet ports of the right-hand side cylinder head cylinder heads of the engine via the bolted connection of the two cylinder bolts.

In select embodiments of the disclosed replacement exhaust manifold, a plurality of indentions may be included on the central channel body. The plurality of indentions may be positioned between each adjacent exhaust port. Wherein the plurality of indentions may be configured for receiving glow plug and related electrical connection protrusions from the engine for installing the replacement exhaust manifold on the engine.

In select embodiments of the disclosed replacement exhaust manifold, the turbo connection may be a rectangular flange. The rectangular flange may be configured to attach to the retrofitted turbocharger of the engine. In select embodiments, the turbo connection may include an upward curved connection at the second end of the central channel body. The upward curved connection may terminate with the rectangular flange. The rectangular flange may have four turbo holes therethrough at each rectangle corner of the rectangular flange. Whereby, the rectangular flange may be bolted to the turbocharger via four turbo bolts where the upward curved connection is sealed to the turbocharger via the four turbo bolts. In select embodiments, the rectangular flange may be an industry standard T-3 turbo mounting flange. Whereby, the replacement exhaust manifold may allow the turbocharger with a T-3 mounting flange to be retrofitted to the engine. Whereby, the replacement exhaust manifold may be configured to gather exhaust gasses from both banks of the cylinder heads of the engine and efficiently route such exhaust gasses through the T-3 mounting flange with a minimum reduction in velocity.

In another aspect, the instant disclosure embraces a retrofitted engine. The retrofitted engine disclosed herein my generally include the replacement exhaust manifold in any of the various embodiments, or combinations of embodiments, shown and/or described herein. Accordingly, the retrofitted engine may include the replacement exhaust manifold for retrofitting a turbocharger to the retrofitted engine in any of the various embodiments, or combinations of embodiments, shown and/or described herein. As such, the replacement exhaust manifold in the retrofitted engine may generally include a central channel body, an exhaust connection, a turbo connection, and a plurality of exhaust ports. The central channel body may have a first end and a second end. The exhaust connection may be connected to the first end of the central channel body. The exhaust connection may be configured to be attached to an exhaust system for the engine. The turbo connection may be connected to the second end of the central channel body. The turbo connection may be configured to be attached to the turbocharger. The plurality of exhaust ports may be along the central channel body. Each of the exhaust ports may be configured to be attached to a corresponding exhaust outlet port on a cylinder head of the engine. Wherein, the replacement exhaust manifold may be configured to be attached to the engine for retrofitting the turbocharger to the engine.

One feature of the disclosed retrofitted engine may be that the replacement exhaust manifold may be configured to replace an original equipment exhaust manifold for retrofitting the turbocharger to the engine.

Another feature of the disclosed retrofitted engine may be that the retrofitted engine may be a 6.2 non-turbo diesel engine or a 6.5 non-turbo diesel engine. The replacement exhaust manifold may be mounted on a right side cylinder head of the 6.2 non-turbo diesel engine or the 6.5 non-turbo diesel engine, like on a civilian or military high mobility multipurpose wheeled vehicle. Wherein, the replacement exhaust manifold may work within tight confines of the under-hood area on the vehicle housing the engine, where the replacement exhaust manifold may be designed to make acceptable clearance to all under-hood obstacles and allow the retrofitted turbocharger to function.

In another aspect, the instant disclosure embraces a method of retrofitting a turbocharger to an engine. The method of retrofitting a turbocharger to an engine disclosed herein my generally include utilizing the replacement exhaust manifold in any of the various embodiments, or combinations of embodiments, shown and/or described herein. Accordingly, the method of retrofitting a turbocharger to an engine may include providing the replacement exhaust manifold for retrofitting a turbocharger to the retrofitted engine in any of the various embodiments, or combinations of embodiments, shown and/or described herein. As such, the provided replacement exhaust manifold may generally include a central channel body, an exhaust connection, a turbo connection, and a plurality of exhaust ports. The central channel body may have a first end and a second end. The exhaust connection may be connected to the first end of the central channel body. The exhaust connection may be configured to be attached to an exhaust system for the engine. The turbo connection may be connected to the second end of the central channel body. The turbo connection may be configured to be attached to the turbocharger. The plurality of exhaust ports may be along the central channel body. Each of the exhaust ports may be configured to be attached to one of a plurality of exhaust outlet ports in the right-hand side cylinder head of the engine. Wherein, the replacement exhaust manifold may be configured to be attached to the engine for retrofitting the turbocharger to the engine. With the provided replacement exhaust manifold, the disclosed method of retrofitting a turbocharger to an engine may also include the steps of: removing an original equipment exhaust manifold from the engine; installing the replacement exhaust manifold on the engine including bolting each of the plurality of exhaust ports to one of the corresponding exhaust outlet ports on the right-hand side cylinder head of the engine via diamond shape flanges, and bolting the exhaust connection to the exhaust system of the vehicle; and retrofitting the turbocharger onto the engine by bolting the turbocharger to the turbo connection via a rectangular flange or a standard T-3 turbo mounting flange of the installed replacement exhaust manifold on the engine.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1A:
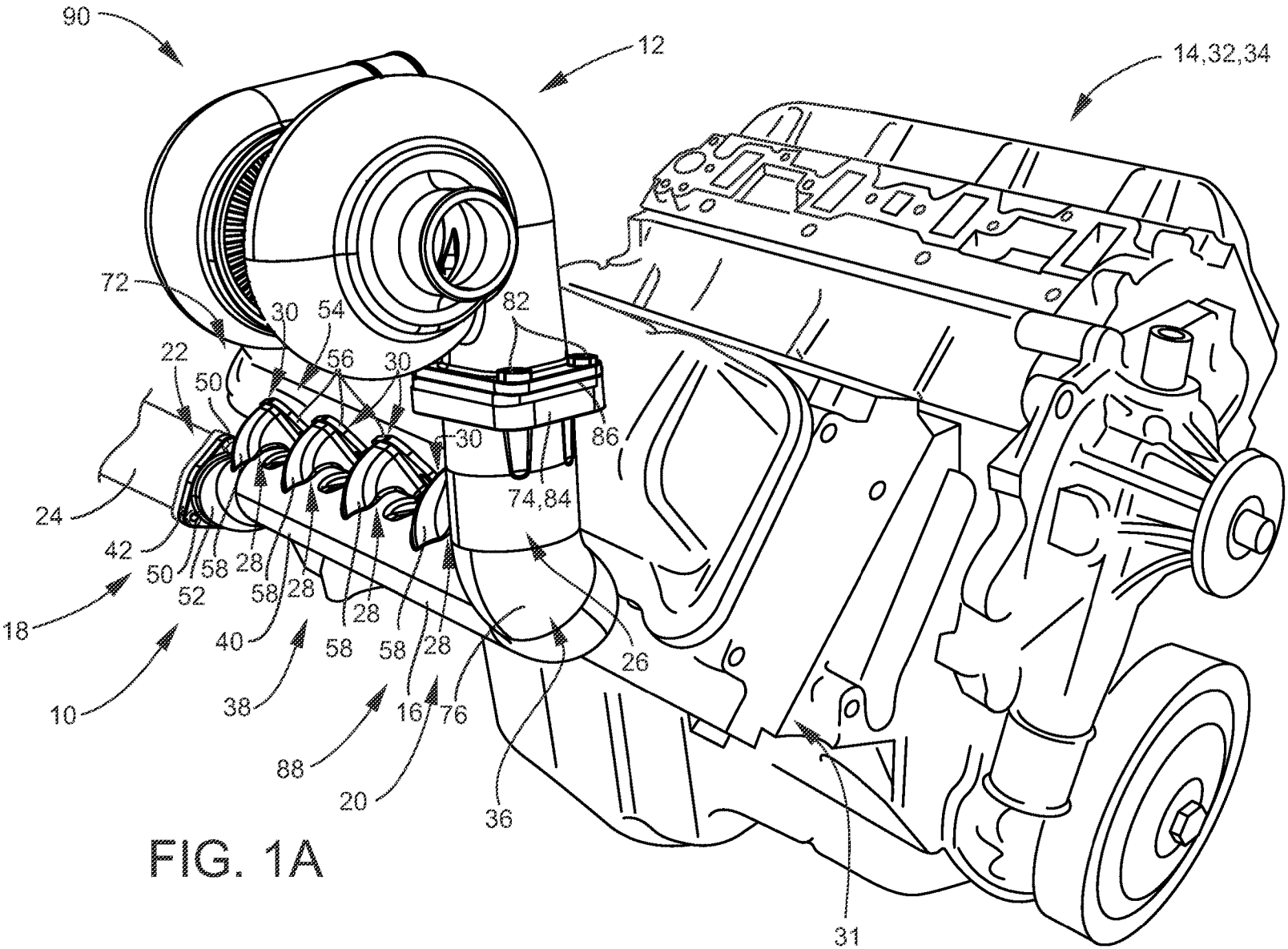
FIG. 1A is a perspective environmental view of the disclosed replacement exhaust manifold according to select embodiments of the instant disclosure installed on an engine and connected to the exhaust system and a turbocharger.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-20, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring now to FIGS. 1-19, in a possibly preferred embodiment, the present disclosure overcomes the above-mentioned disadvantages and meets the recognized need for such an apparatus, system or method by providing of the disclosed replacement exhaust manifold 10. The present disclosure may be designed and provided to solve the aforementioned limitations of the currently available engines and means for retrofitting non-turbo engines, by providing of replacement exhaust manifold 10 that may be configured for retrofitting turbocharger 12 onto engine 14, which may be originally a non-turbo version of the engine. The disclosed device, system or method may thus be configured for various engines 14, including diesel engines, like 6.2 non-turbo diesel engine 32, 6.5 non-turbo diesel engine 34, or the like, to allow for retrofitting of turbocharger 12 on such non-turbo engines 14, like on civilian or military high mobility multipurpose wheeled vehicles. Replacement exhaust manifold 10 for retrofitting turbocharger 12 to engine 14 may generally include central channel body 16, exhaust connection, turbo connection 26, and plurality of exhaust ports 28. These parts and their operation may be described in greater detail below.

Central channel body 16 may be included in replacement exhaust manifold 10. See FIGS. 1-19. Central channel body 16 may be for providing the main body of the exhaust manifold that provides the structure and connection for exhaust gases between exhaust ports 28 to exhaust connection 22 and turbo connection 26. Central channel body 16 may be shaped and designed accordingly, or as desired to fit the desired engine 14. As shown in the Figures, in select possibly preferred embodiments, central channel body 16 may have a substantially cylindrical shape with a passageway therethrough for providing the structure and connection for exhaust gases between exhaust ports 28 to exhaust connection 22 and turbo connection 26. Central channel body 16 may have first end 18 and second end 20. First end 18 may be connected to and in communication with exhaust connection 22. Second end 20 may be connected to and in sealed communication with turbo connection 26. Central channel body 16 may also have plurality of exhaust ports 28 connected throughout between first end 18 and second end 20. Central channel body 16 and the components connected thereto of replacement exhaust manifold 10 may be made by any processes and by any desired materials for an operating exhaust manifold. In select embodiments, as shown in the Figures, central channel body 16 and the components connected thereto of replacement exhaust manifold 10 may be made of cast ductile iron 40, or the like. In select embodiments of replacement exhaust manifold 10, a plurality of indentions 70 may be included on central channel body 16. The plurality of indentions 70 may be positioned between each adjacent exhaust port 28. Wherein the plurality of indentions 70 may be configured for receiving protrusions 72, like glow plug and related electrical connection protrusions, from engine 14 for installing replacement exhaust manifold 10 on engine 14.

Exhaust connection 22 may be included with replacement exhaust manifold 10. See FIGS. 1-19. Exhaust connection 22 may be for providing a means and location for connecting central channel body 16 to exhaust system 24 of engine 14. See FIG. 1. Exhaust connection 22 may include any means, devices, mechanisms, shapes, configurations, methods, the like, etc. configured to connect and seal central channel body 16 to exhaust system 24 of engine 14. Exhaust connection 22 may be connected to first end 18 of central channel body 16. As such, exhaust connection 22 may be configured to be attached to and sealed with exhaust system 24 for engine 14 at first end 18. In select possibly preferred embodiments of replacement exhaust manifold 10, exhaust connection 22 may be triangular flange 42, as shown in the Figures. However, the disclosure is not so limited, and any type of connection to exhaust system 24 may be used. Triangular flange 42 may be configured to attach to exhaust system 24 of engine 14. Triangular flange 42 may include circular channel 44 for allowing exhaust gases 36 to flow from central channel body 16 into exhaust system 24. Triangular flange 42 may also include three exhaust holes 46 therethrough at each triangle corner 48 of triangular flange 42. Whereby, triangular flange 42 may be bolted to exhaust system 24 via three exhaust bolts 50 where circular channel 44 may be configured to be sealed to exhaust system 24 via the force and pressure applied from exhaust bolts 50. In select embodiments, exhaust connection 22 may be connected to first end 18 of central channel body 16 via S-shaped connection 52. S-shaped connection 52 may be configured to lower exhaust connection 22 below central channel body 16. This configuration may be required for fitting replacement exhaust manifold 10 onto engine 14, like 6.2 diesel engine 32 and/or 6.5 diesel engine 34. In select embodiments, exhaust end port 54 of one of the plurality of exhaust ports 28 may be positioned along S-shaped connection 52.

Turbo connection 26 may be included with replacement exhaust manifold 10. See FIGS. 1-19. Turbo connection 26 may be for providing a means and location for connecting central channel body 16 to turbocharger 12 for engine 14. See FIG. 1. Turbo connection 26 may include any means, devices, mechanisms, shapes, configurations, methods, the like, etc. configured to connect and seal central channel body 16 to turbocharger 12 of engine 14. Turbo connection 26 may be connected to second end 20 of central channel body 16. As such, turbo connection 26 may be configured to be attached to and sealed with turbo 12 at second end 20 of central channel body 16. In select embodiments of replacement exhaust manifold 10, turbo connection 26 may be rectangular flange 74. However, the disclosure is not so limited, and any type of connection to turbocharger 12 may be used. Rectangular flange 74 may be configured to attach to retrofitted turbocharger 12 of engine 14. In select embodiments, turbo connection 26 may include upward curved connection 76 at second end 20 of central channel body 16. Upward curved connection 76 may be for positioning turbocharger 12 in the proper orientation on top of rectangular flange 74 and in a position that fits turbocharger 12 on engine 14, like on 6.2 diesel engine 32, 6.5 diesel engine 34, or the like Upward curved connection 76 of turbo connection 26 may terminate with rectangular flange 74. Rectangular flange 74 may have four turbo holes 78 therethrough at each rectangle corner 80 of rectangular flange 74. Whereby, rectangular flange 74 may be bolted to turbocharger 12 via four turbo bolts 82 where upward curved connection 76 is sealed to turbocharger 12 via the force from the four turbo bolts 82. In select embodiments, rectangular flange 74 may be industry standard T-3 turbo mounting flange 84, as shown in the Figures. Whereby, replacement exhaust manifold 10 may allow turbocharger 12 with T-3 mounting flange 86 to be retrofitted to engine 14. Whereby, replacement exhaust manifold 10 may be configured to gather exhaust gasses 36 from both banks 88 of cylinder heads 31 of engine 14 and efficiently route such exhaust gasses 36 through T-3 mounting flange 86 with a minimum reduction in velocity. Although not shown in FIG. 1A, turbocharger 12 may be connected to the engine's air intake via the outlet port (port facing engine 14 in FIG. 1A) of turbocharger 12. In addition, turbocharger 12 may include a turbo air filter box which may connect to the turbo's air intake port (port facing forward in FIG. 1A).

Plurality of exhaust ports 28 may be included with replacement exhaust manifold 10. See FIGS. 1-19. Plurality of exhaust ports 28 may be for providing a means and location for connecting central channel body 16 to one of the plurality of cylinder heads 31 of engine 14. See FIG. 1. Exhaust ports 28 may include any means, devices, mechanisms, shapes, configurations, methods, the like, etc. configured to connect and seal central channel body 16 to one of the plurality of cylinder heads 31 of engine 14. Plurality of exhaust ports 28 may be positioned along or on the side of central channel body 16. As such, each of the exhaust ports 28 may be configured to be attached to and sealed with one of a plurality of corresponding exhaust outlet ports 30 of the right-hand side cylinder head cylinder head 31 of engine 14. In select possibly preferred embodiments of replacement exhaust manifold 10, the plurality of exhaust ports 28 may include four exhaust ports 28. With this configuration, one exhaust port 28 may be connected to each of the four corresponding exhaust outlet ports 30 of the right-hand side cylinder head 31 of 6.2 non-turbo diesel engine 32, 6.5 non-turbo diesel engine 34, or the like, like on civilian or military high mobility multipurpose wheeled vehicles. In other select embodiments of replacement exhaust manifold 10, each exhaust port 28 may include diamond shaped flange 56. However, the disclosure is not so limited, and any type of connection to exhaust outlet ports 30 may be used. Diamond shaped flange 56 may be configured to attach to one of the corresponding exhaust outlet ports 30 of engine 14. Each of the exhaust ports 28 may include curved rectangular channel 58 protruding from central channel body 16 and terminating with diamond shaped flange 56. These curved rectangular channels 58 may be designed and configured to fit replacement exhaust manifold 10 onto engine 14, like 6.2 diesel engine 32, 6.5 diesel engine 34, or the like. Each of the diamond shaped flanges 56 may include first notch 60 at one diamond corner 62 and second notch 64 at opposite diamond corner 66. Whereby, each of the diamond shaped flanges 56 may be bolted to one of the corresponding exhaust outlet ports 30 of the right-hand side cylinder head 31 of engine 14 via two cylinder bolts 68. One of the cylinder bolts 68 may go through first notch 60 and another cylinder bolt 68 may go through second notch 64. First notch 60 and second notch 64 may allow for some adjustability between replacement exhaust manifold 10 and cylinder heads 30 of engine 14. Wherein, each rectangular channel 58 of exhaust ports 28 may be sealed to one of the corresponding exhaust outlet ports 30 of the right-hand side cylinder head 31 of engine 14 via the bolted connection of the two cylinder bolts 68, where the force applied from the two cylinder bolts 68 may seal diamond shaped flange 56 to the corresponding exhaust outlet ports 30 of the right-hand side cylinder head 31.

Figure 1B:
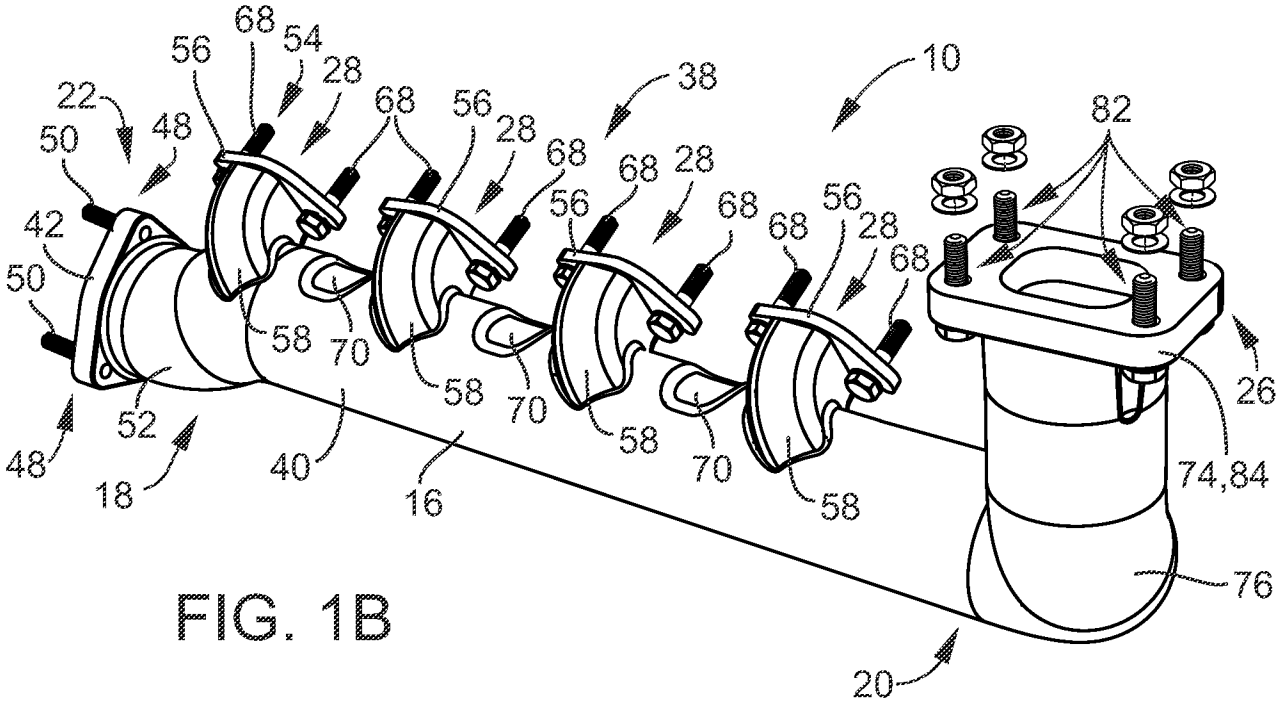
FIG. 1B is a perspective disassembled view of the replacement exhaust manifold of FIG. 1A with the replacement exhaust manifold removed from the engine to show how the replacement exhaust manifold is bolted to the engine.
Figure 2:
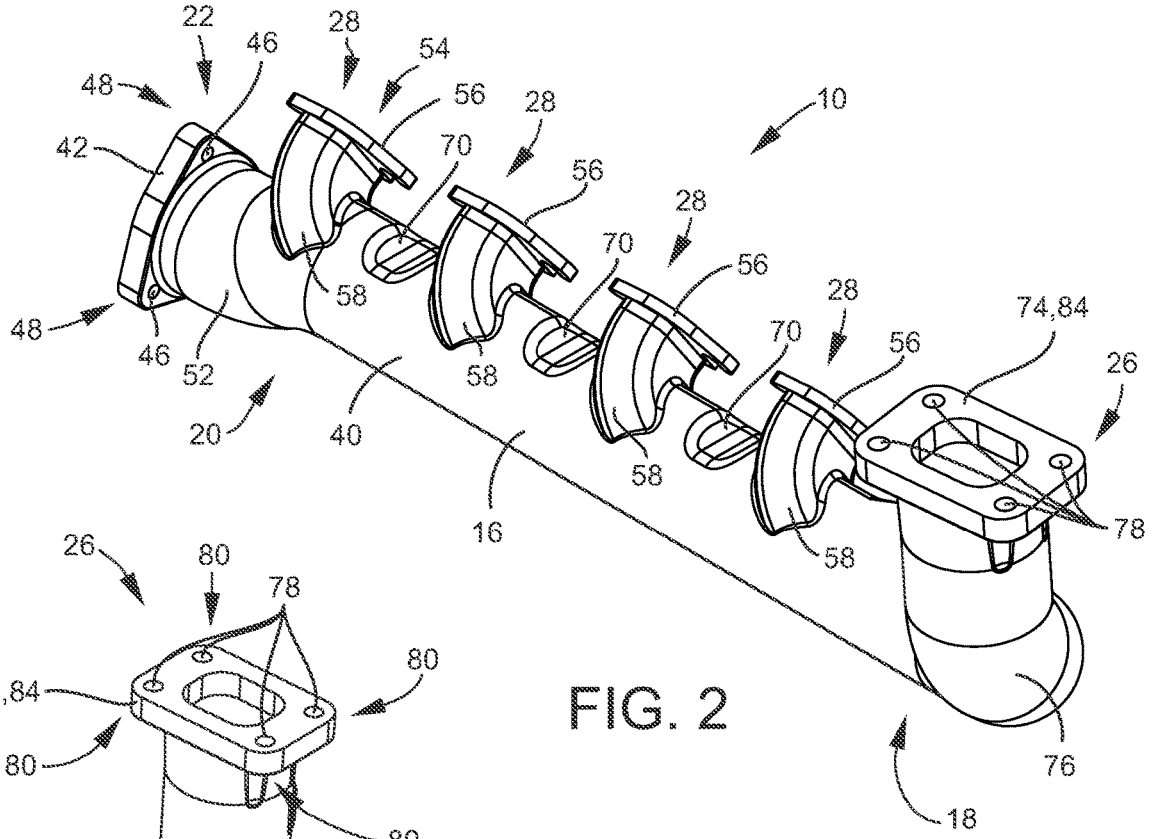
FIG. 2 is a top-right, front side perspective view of the replacement exhaust manifold of FIG. 1A.
Figure 3:
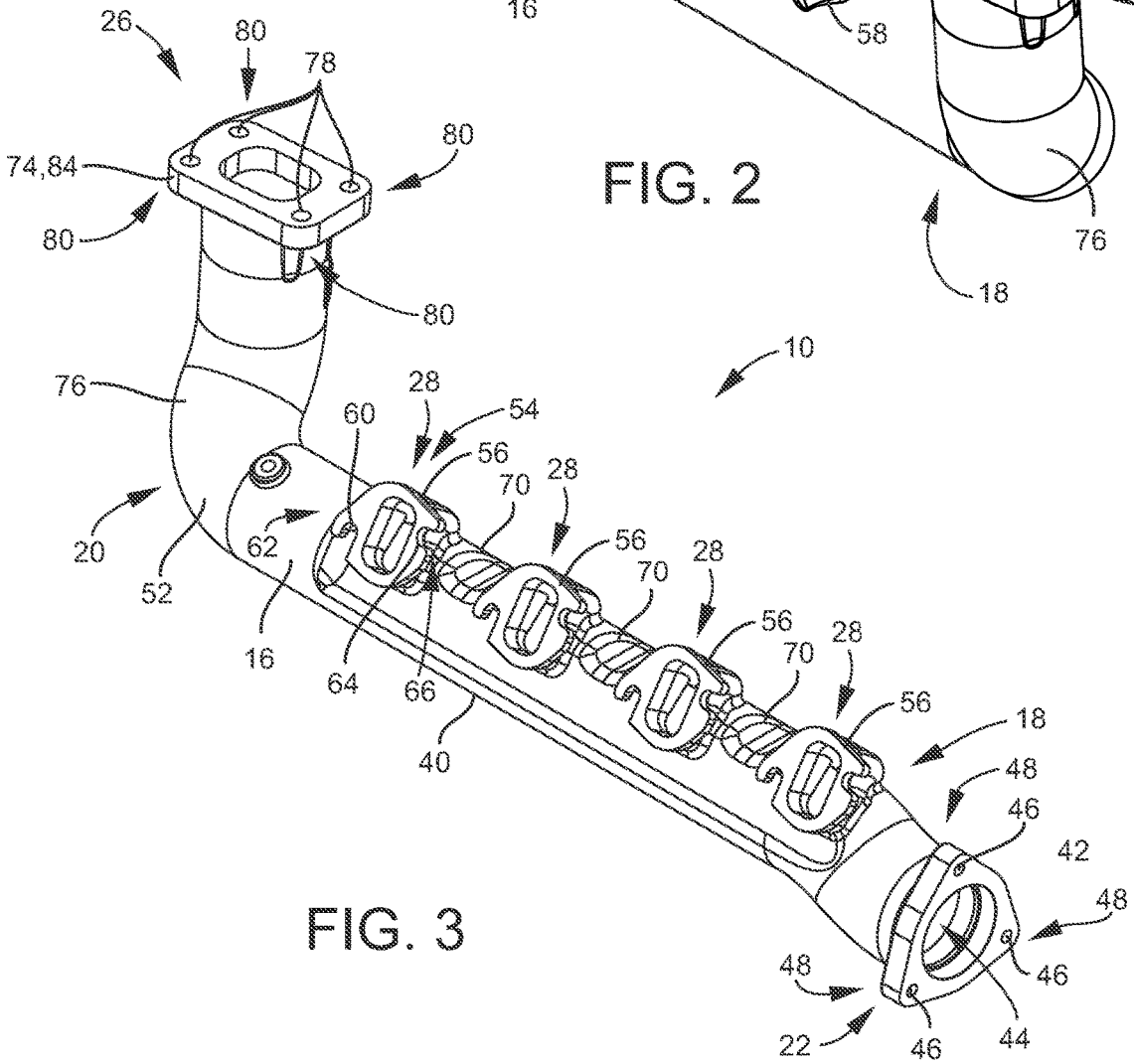
FIG. 3 is a top-right, back side perspective view of the replacement exhaust manifold of FIG. 1A.
Figure 4:
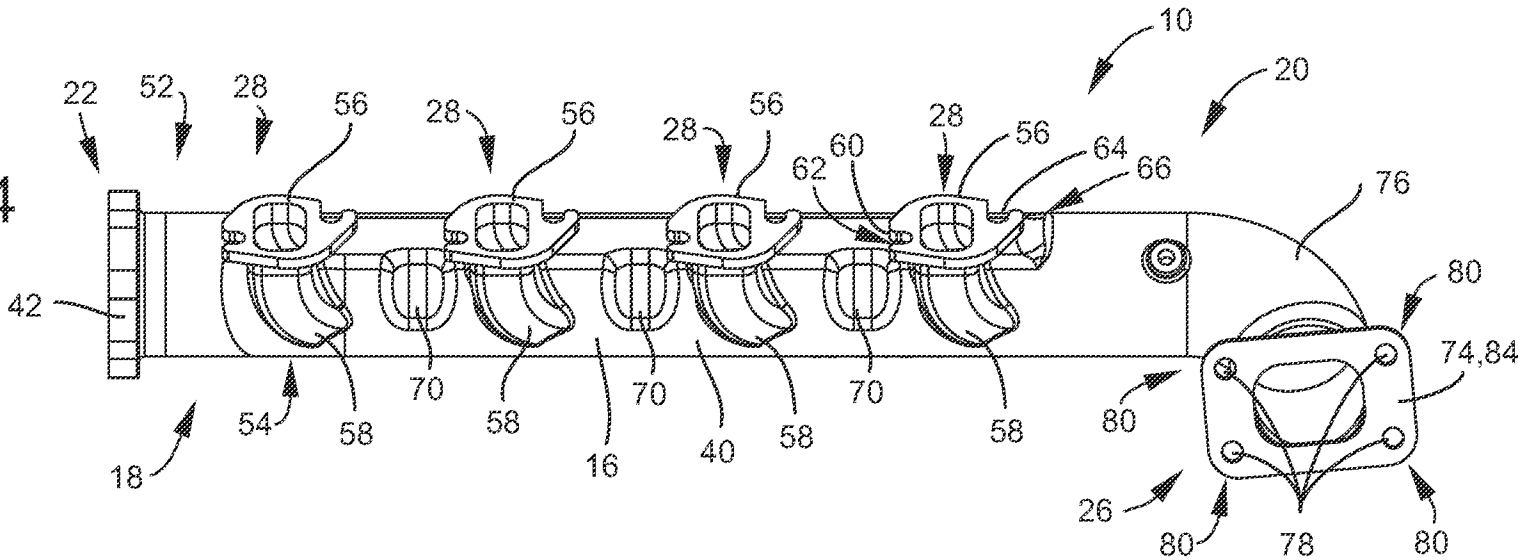
FIG. 4 is a top view of the replacement exhaust manifold of FIG. 1A.
Figure 5:
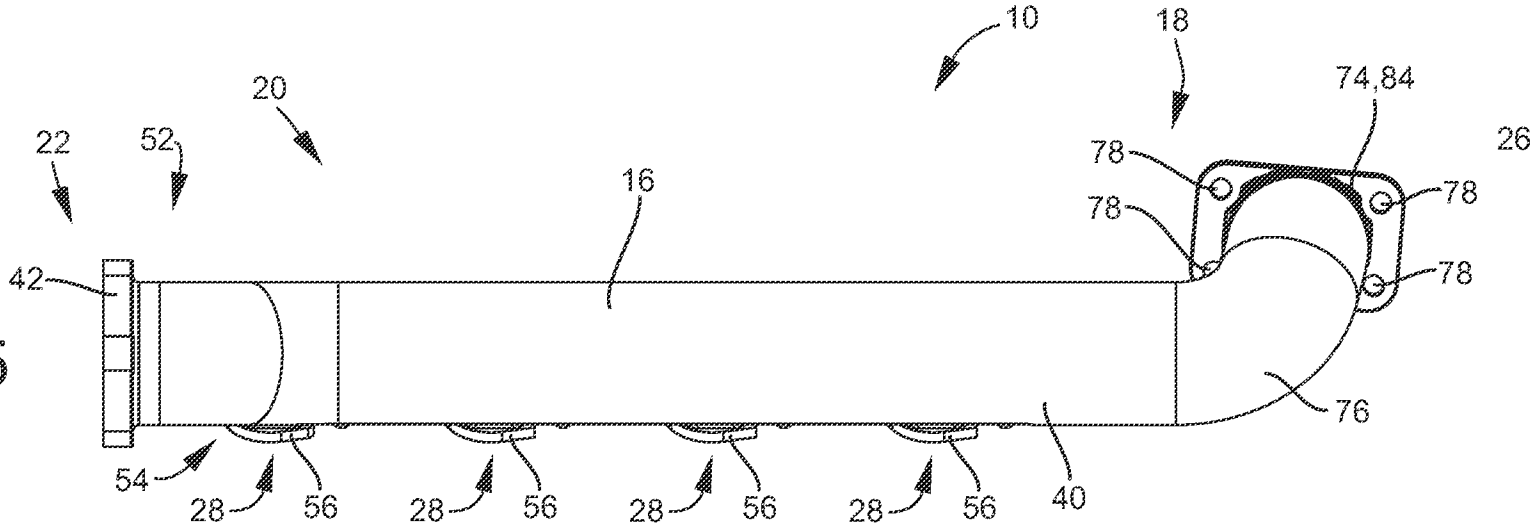
FIG. 5 is a bottom view of the replacement exhaust manifold of FIG. 1A.
Figure 6:
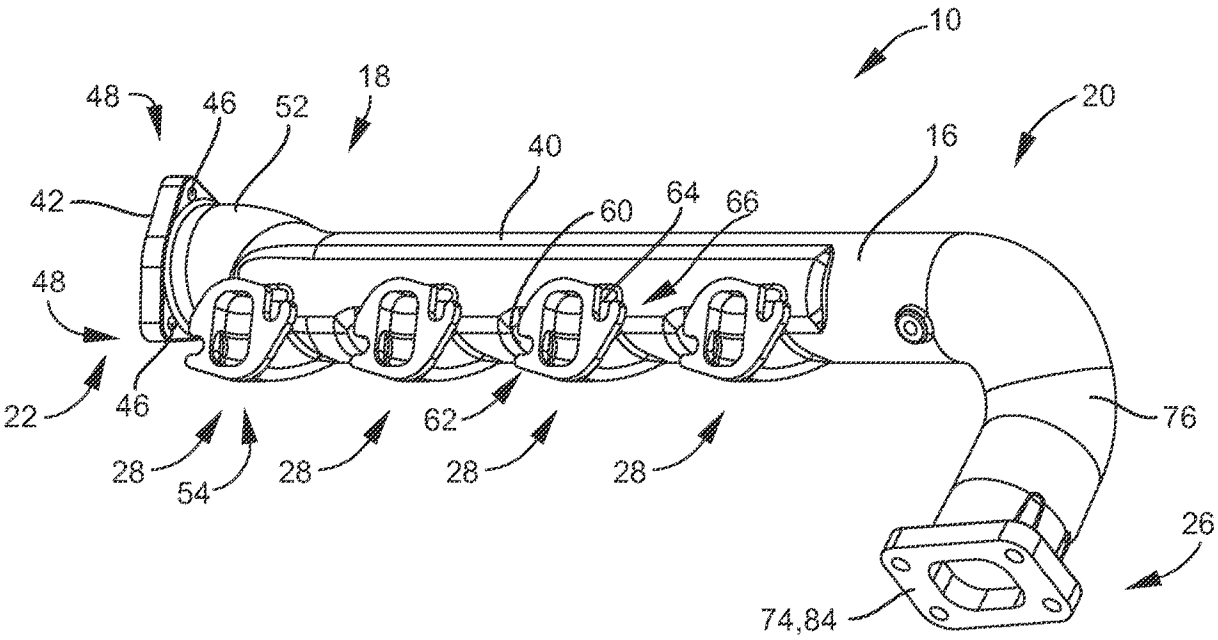
FIG. 6 is a right bottom perspective view of the replacement exhaust manifold of FIG. 1A.
Figure 7:
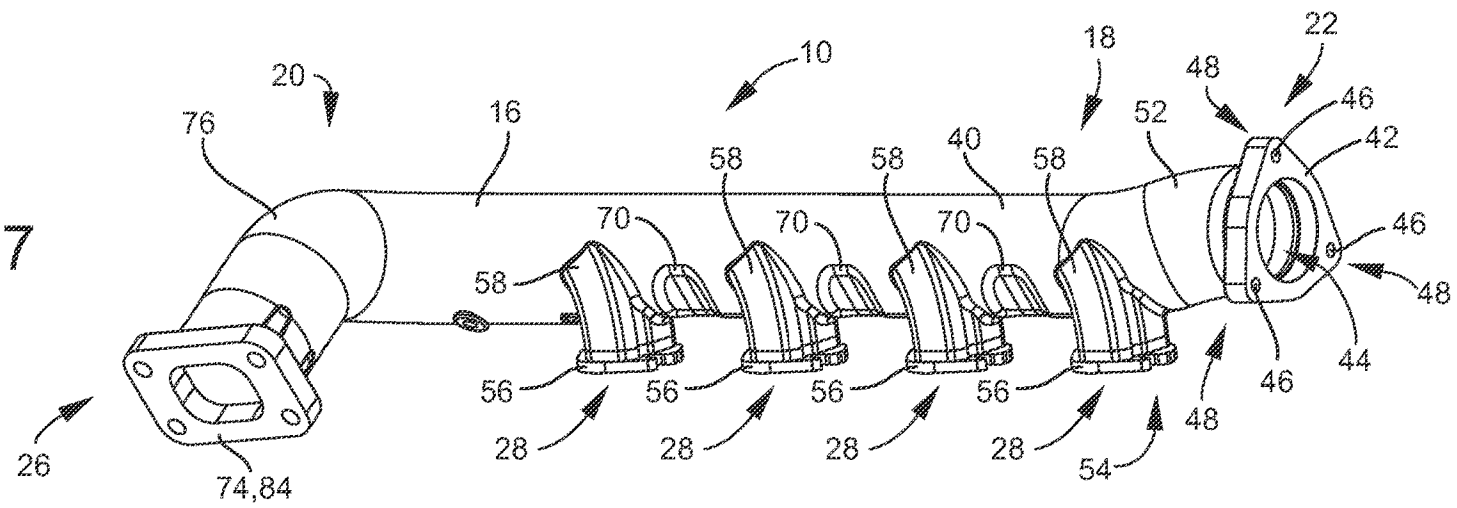
FIG. 7 is a right top perspective view of the replacement exhaust manifold of FIG. 1A.
Figure 9:
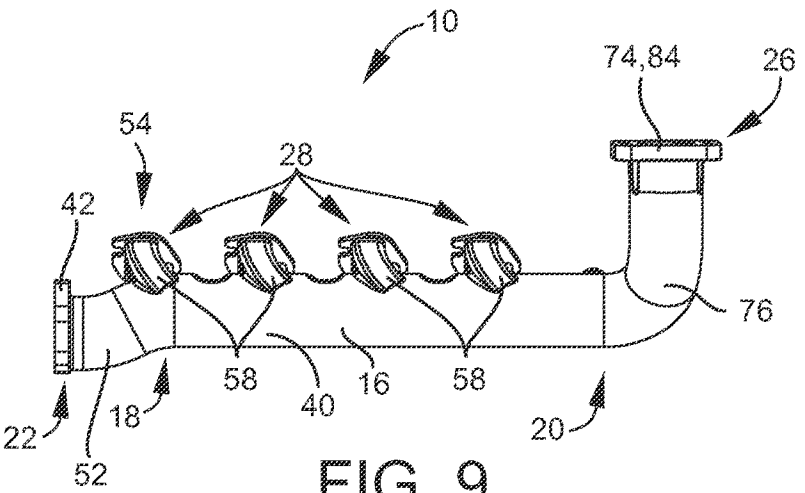
FIG. 9 is a front side view of the replacement exhaust manifold of FIG. 1A.
Figure 11:
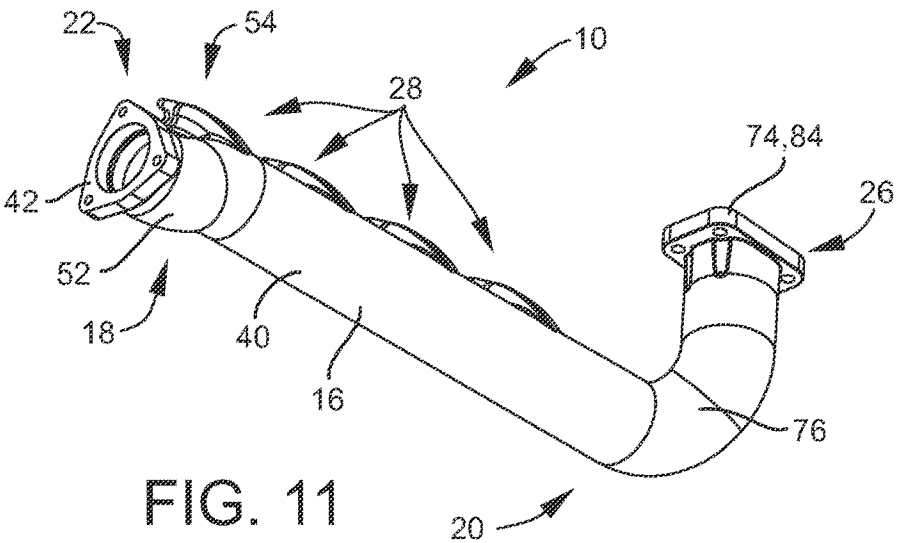
FIG. 11 is a top-left front side perspective view of the replacement exhaust manifold of FIG. 1A.
Figure 8:
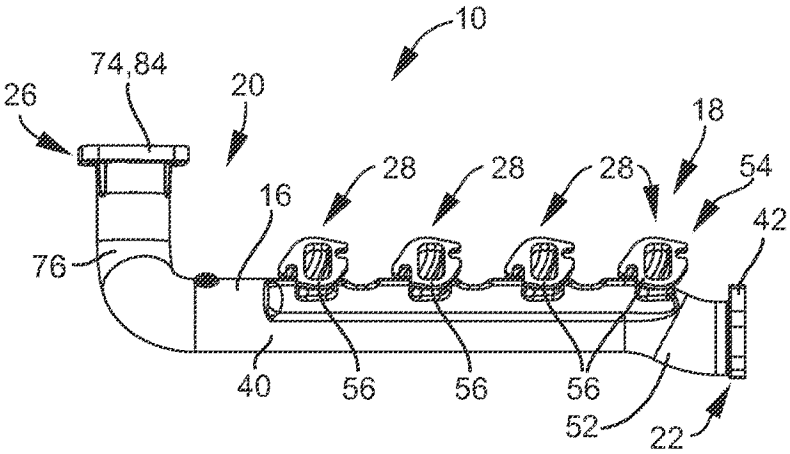
FIG. 8 is a back side view of the replacement exhaust manifold of FIG. 1A.
Figure 10:
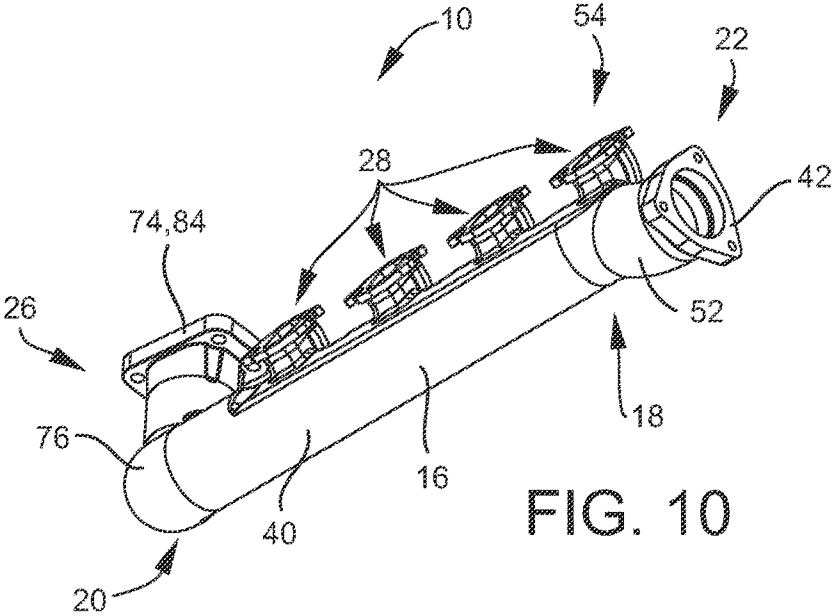
FIG. 10 is a bottom-left back side bottom perspective view of the replacement exhaust manifold of FIG. 1A.
Figure 13:
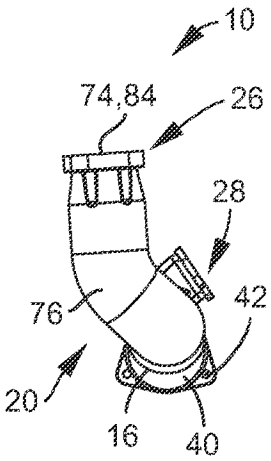
FIG. 13 is a right side view of the replacement exhaust manifold of FIG. 1A.
Figure 12:
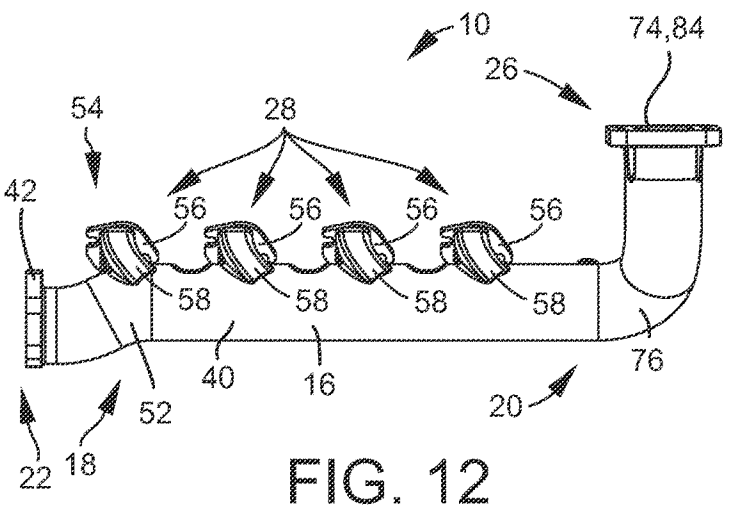
FIG. 12 is a front view of the replacement exhaust manifold of FIG. 1A.
Figure 15:
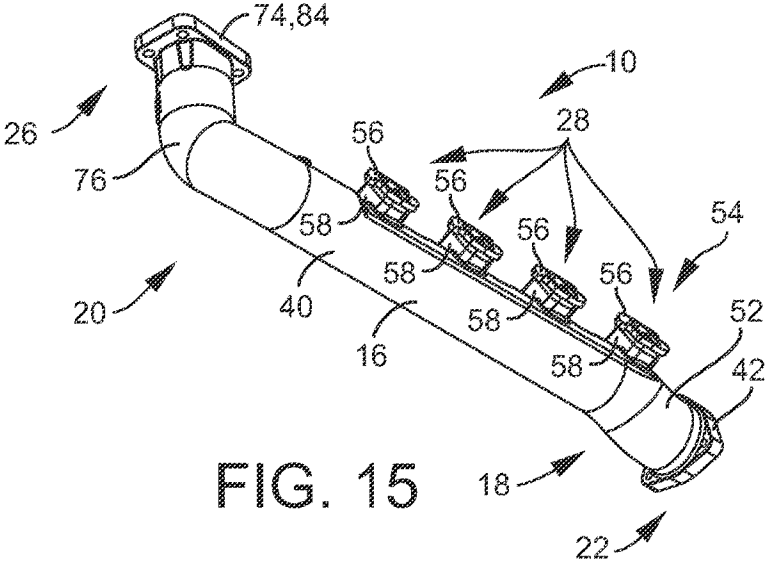
FIG. 15 is a bottom-right back side perspective view of the replacement exhaust manifold of FIG. 1A.
Figure 14:
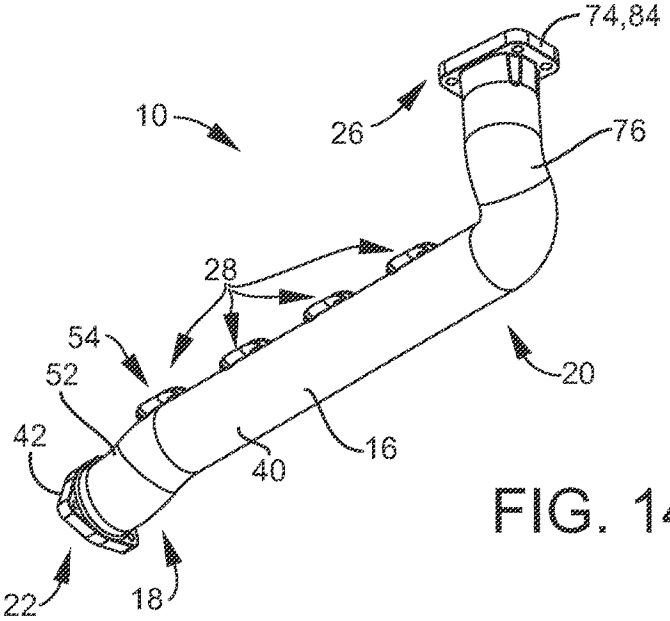
FIG. 14 is a bottom-right front side perspective view of the replacement exhaust manifold of FIG. 1A.
Figure 16:
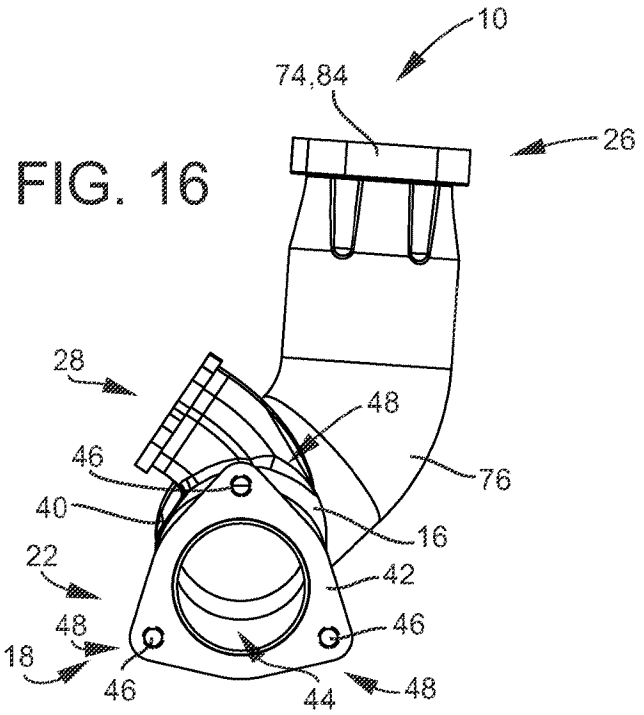
FIG. 16 is a left side perspective view of the replacement exhaust manifold of FIG. 1A.
Figure 17:
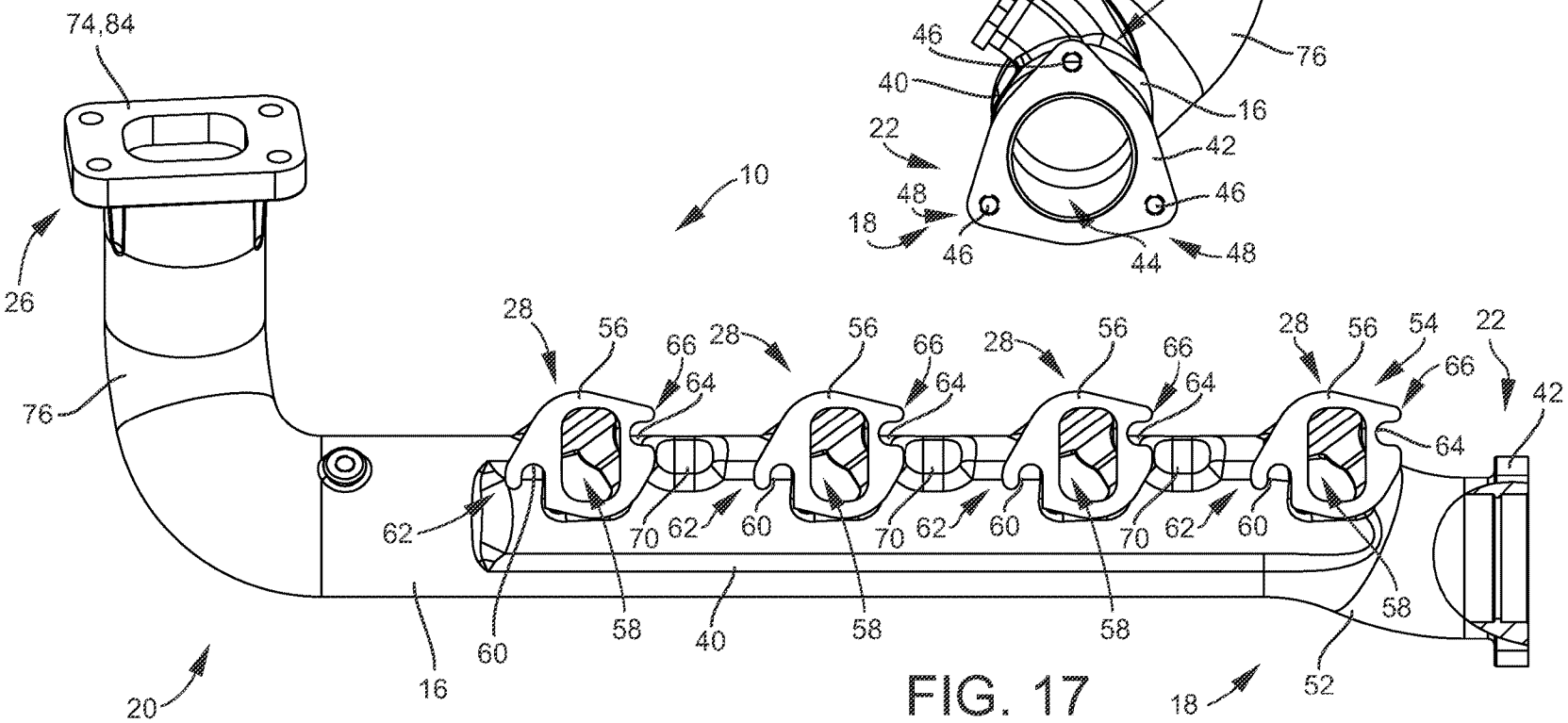
FIG. 17 is a back top perspective view of the replacement exhaust manifold of FIG. 1A.
Figure 18B:
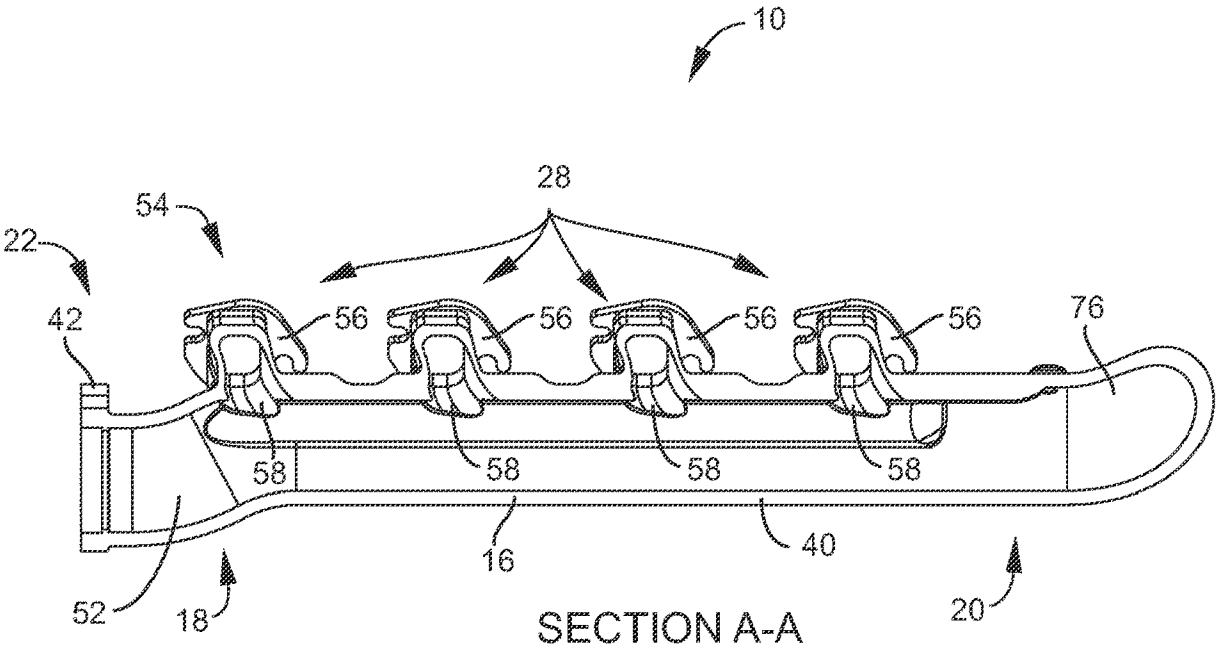
FIG. 18B is a front side cutaway view across section A-A of the replacement exhaust manifold of FIG. 18A.
Figure 18A:
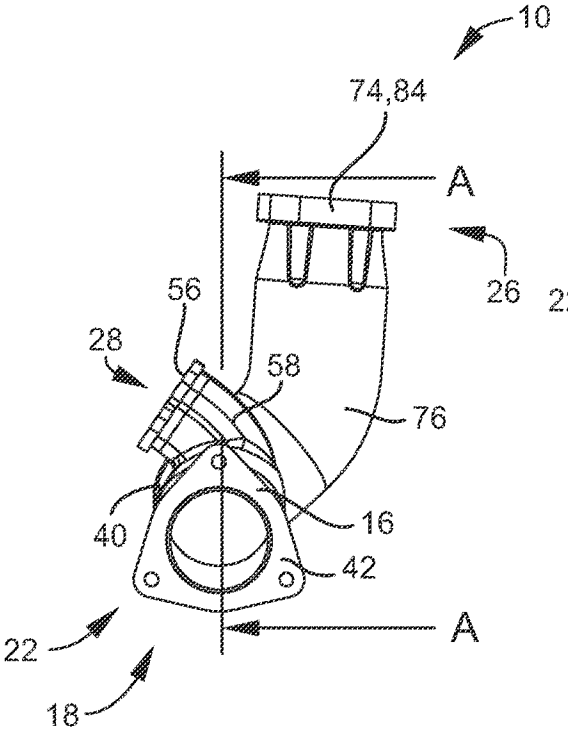
FIG. 18A is a left side view of the replacement exhaust manifold of FIG. 1A with reference to cross-section view A-A of FIG. 18B.
Figure 19B:
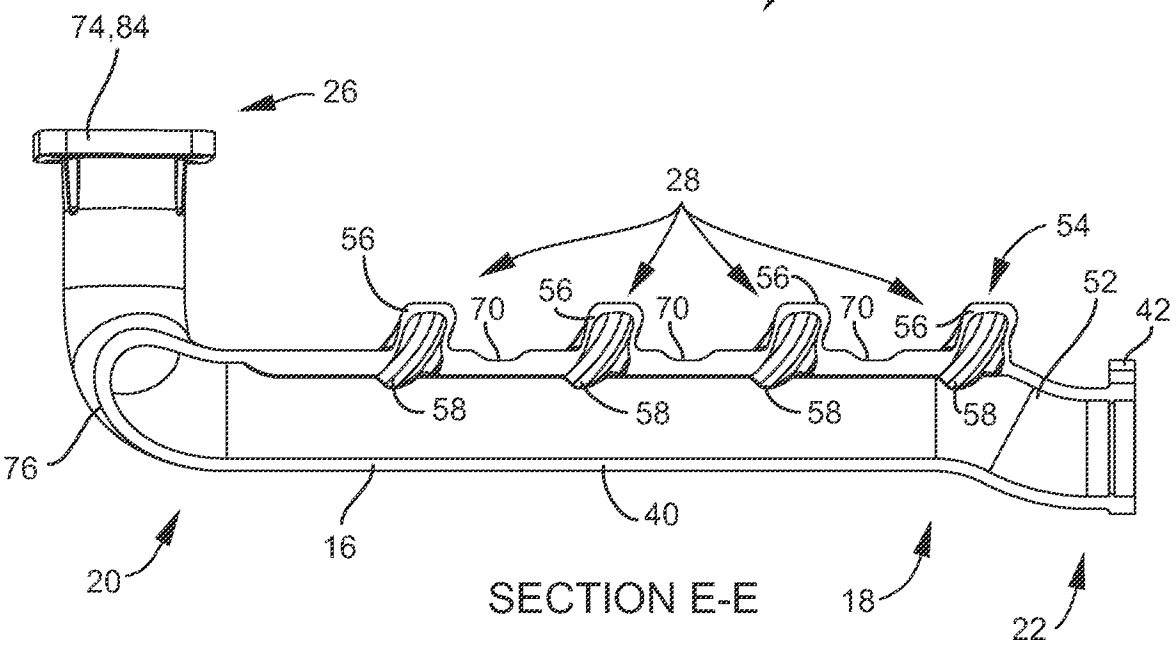
FIG. 19B is a back side cutaway view across section E-E of the replacement exhaust manifold of FIG. 19A.
Figure 19A:
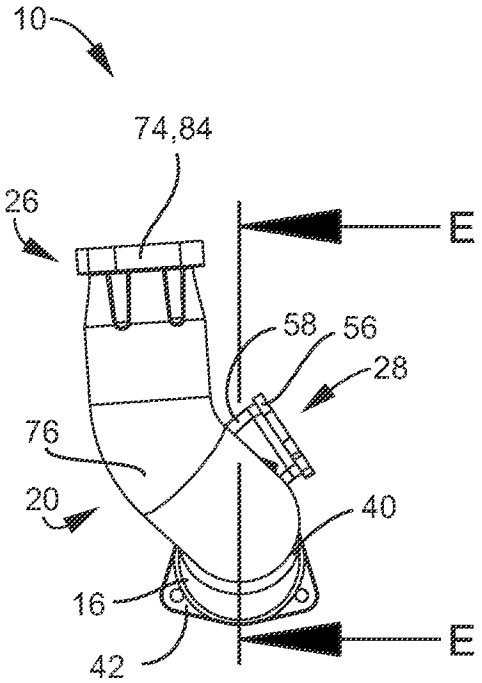
FIG. 19A is a right side view of the replacement exhaust manifold of FIG. 1A with reference to cross-section view E-E of FIG. 19B.

Replacement exhaust manifold 10 may be configured to be attached to engine 14 for retrofitting turbocharger 12 to engine 14 One feature of replacement exhaust manifold 10 may be that it can be configured to replace an original equipment exhaust manifold for retrofitting turbocharger 12 to engine 14. Another feature of replacement exhaust manifold may be that it can be configured to retrofit 6.2 non-turbo diesel engine 32 or 6.5 non-turbo diesel engines 34, as schematically shown in FIG. 1, like on civilian or military high mobility multipurpose wheeled vehicles. Replacement exhaust manifold 10 may be configured to be mounted on the right side cylinder heads of the 6.2 non-turbo diesel engine 32 or the 6.5 non-turbo diesel engine 34. Wherein, replacement exhaust manifold 10 may be configured to work within tight confines of the under-hood area on the vehicle housing engine 14. Replacement exhaust manifold 10 may be designed to make acceptable clearance to all under-hood obstacles and allow the retrofitted turbocharger 12 to function.

Another feature of replacement exhaust manifold 10 may be that it can be configured to facilitate the collection of all exhaust gases 36 of engine 14 and route such exhaust gases 36 through turbo connection 26. See FIG. 1. This feature may result in an increase in power from engine 14 via the retrofitted turbocharger 12. Replacement exhaust manifold 10 may receive the incoming exhaust gases 36 and may channel them to the retrofitted turbocharger 12, thereby resulting in available boost and additional power for engine 14.

Another feature of replacement exhaust manifold 10 may be that it can be configured to allow self-contained bolt-on product 38. See FIG. 1. This self-contained bolt-on product 38 provided by replacement exhaust manifold 10 may be to facilitate retrofitting turbocharger 12 to engine 14.

Another feature of replacement exhaust manifold 10 may be that it can be configured to allow engine 14 to be retrofitted with turbocharger 12 without the need to replace engine 14, replace the engine cover, lift a truck body in order for to retrofit turbocharger 12 to engine 14, the like, or combinations thereof.

Referring now specifically to FIG. 1, in another aspect, the instant disclosure embraces retrofitted engine 90. Retrofitted engine 90 disclosed herein my generally include replacement exhaust manifold 10 in any of the various embodiments, or combinations of embodiments, shown and/or described herein. Accordingly, retrofitted engine 90 may include replacement exhaust manifold 10 for retrofitting turbocharger 12 to retrofitted engine 14 in any of the various embodiments, or combinations of embodiments, shown and/or described herein. As such, replacement exhaust manifold 10 on retrofitted engine 90 may generally include central channel body 16, exhaust connection 22, turbo connection 26, and plurality of exhaust ports 28. Central channel body 16 may have first end 18 and second end 20. Exhaust connection 22 may be connected to first end 18 of central channel body 16. Exhaust connection 22 may be configured to be attached to exhaust system 24 for retrofitted engine 90. Turbo connection 26 may be connected to second end 20 of central channel body 16. Turbo connection 26 may be configured to be attached to turbocharger 12. The plurality of exhaust ports 28 may be along central channel body 16. Each of the exhaust ports 28 may be configured to be attached to one of a plurality of exhaust outlet ports 30 of right-hand side cylinder heads 31 of retrofitted engine 90, like four exhaust ports 28 attached to four exhaust outlet ports 30 on right-hand side cylinder head 31, like on a 6.2 diesel engine 32, a 6.5 diesel engine 34, or the like. Wherein, replacement exhaust manifold 10 may be configured to be attached to retrofitted engine 90 for retrofitting turbocharger 12 to retrofitted engine 90. One feature of the disclosed retrofitted engine 90 may be that replacement exhaust manifold 10 may be configured to replace an original equipment exhaust manifold for retrofitting the turbocharger 12 to retrofitted engine 90. Another feature of the disclosed retrofitted engine 90 may be that retrofitted engine 90 may be 6.2 non-turbo diesel engine 32 or 6.5 non-turbo diesel engine 34. Replacement exhaust manifold 10 may be mounted on a right side cylinder head of the 6.2 non-turbo diesel engine 32, the 6.5 non-turbo diesel engine 34, or the like, like on civilian or military high mobility multipurpose wheeled vehicles. Wherein, replacement exhaust manifold 10 may work within tight confines of the under-hood area on the vehicle housing retrofitted engine 90, where the replacement exhaust manifold 10 may be designed to make acceptable clearance to all under-hood obstacles and allow the retrofitted turbocharger 12 to function.

Figure 20:
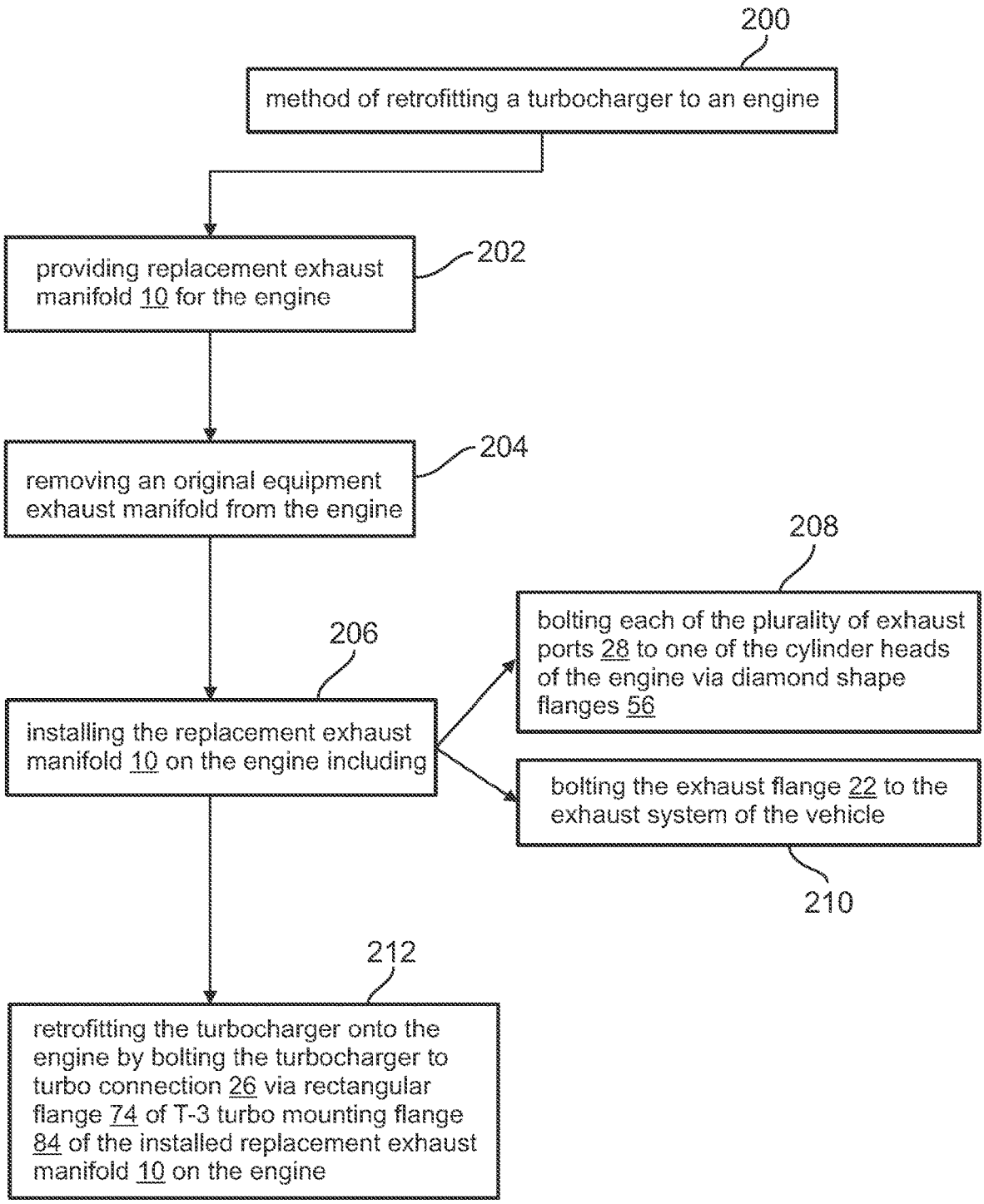
FIG. 20 is a flow diagram of the disclosed method of retrofitting an engine with a turbocharger according to select embodiments of the instant disclosure.

Referring now to FIG. 20, in another aspect, the instant disclosure embraces method 200 of retrofitting a turbocharger to an engine, like retrofitting turbocharger 12 to engine 14. Method 200 of retrofitting a turbocharger to an engine disclosed herein my generally include utilizing replacement exhaust manifold 10 in any of the various embodiments, or combinations of embodiments, shown and/or described herein. Accordingly, method 200 of retrofitting a turbocharger to an engine may include step 202 of providing replacement exhaust manifold 10 for retrofitting turbocharger 12 to retrofitted engine 90 in any of the various embodiments, or combinations of embodiments, shown and/or described herein. As such, the provided replacement exhaust manifold 10 may generally include central channel body 16, exhaust connection 22, turbo connection 26, and plurality of exhaust ports 28. Central channel body 16 may have first end 18 and second end 20. Exhaust connection 22 may be connected to first end 18 of central channel body 16. Exhaust connection 22 may be configured to be attached to exhaust system 24 for retrofitted engine 90. Turbo connection 26 may be connected to second end 20 of central channel body 16. Turbo connection 26 may be configured to be attached to turbocharger 12. The plurality of exhaust ports 28 may be along central channel body 16. Each of the exhaust ports 28 may be configured to be attached to one of a plurality of exhaust outlet ports 30 on right-hand side cylinder head 30 of retrofitted engine 90, like four exhaust ports 28 attached to four exhaust outlet ports 30 on right-hand side cylinder head 31, like on a 6.2 diesel engine 32, a 6.5 diesel engine 34, or the like. Wherein, replacement exhaust manifold 10 may be configured to be attached to retrofitted engine 90 for retrofitting turbocharger 12 to retrofitted engine 90. With the provided replacement exhaust manifold 10, method 200 of retrofitting a turbocharger to an engine may also include the steps of: step 204 of removing an original equipment exhaust manifold from engine 14; step 206 of installing replacement exhaust manifold 10 on engine 14 including step 208 of bolting each of the plurality of exhaust ports 28 to one of the cylinder heads 31 of engine 14 via diamond shape flanges 56, and step 210 of bolting exhaust connection 22 to exhaust system 24 of the vehicle or engine 14; and step 212 of retrofitting turbocharger 12 onto engine 14 by bolting turbocharger 12 to turbo connection 26 via rectangular flange 74 or standard T-3 turbo mounting flange 84 of the installed replacement exhaust manifold 10 on engine 14.

In sum, replacement exhaust manifold 10 is configured to be attached to engine 14 in place of the original equipment manufacturer ("OEM") manifold and allows the user to install turbocharger 12 onto engine 14, like 6.2 non-turbo diesel engine 32, 6.5 non-turbo diesel engine 34, or the like. Replacement exhaust manifold 10 may facilitate the collection of all the engine's exhaust gasses 36 and route them through turbocharger connection 26, allowing for the installation of turbocharger 12, thereby resulting in an increase in power from engine 14 or retrofitted engine 90. The development of replacement exhaust manifold 10 may allows self-contained bolt-on product 38 to facilitate adding turbocharger 12 to these engine applications, not previously available for these chassis. Replacement exhaust manifold 10 may eliminate the need to replace engine 14, replace the "doghouse"/engine cover and/or lift the truck body in order for the user to add turbocharger 12.

Replacement exhaust manifold 10 may be made of cast ductile iron 40 and may have triangular flange 42 at first end 18 for connection to the vehicle's exhaust system 24, four exhaust input ports 28 along the central channel body 16 of replacement exhaust manifold 10, followed by an upward curves connection 76 in the body and ending at second end 20, in an industry standard "T-3" turbo mounting flange 84. Replacement exhaust manifold 10 may be mounted on the right side cylinder head of the 6.2 or 6.5 liter diesel engine (as installed in the AM General® HMMWV and Hummer H-1 chassis, as provided by AM General® of South Bend, Ind.) and may allow for the use of turbocharger 12 in conjunction with these engines (in these chassis configurations). As such, replacement exhaust manifold 10 may specifically be for retrofitting civilian or military high mobility multipurpose wheeled vehicles. Working within the tight confines of the under-hood area on the subject vehicles, replacement exhaust manifold 10 may gather the exhaust gasses 36 from both banks 88 of the engine's cylinder heads 31 and efficiently routes those exhaust gasses 36 through the industry standard T-3 mounting flange 84 with a minimum reduction in velocity. Turbocharger 12 (with T-3 mounting flange 86) may then be attached to industry standard T-3 mounting flange 84 on replacement exhaust manifold 10 and the turbocharger 12 may receive the incoming exhaust gasses 36, resulting in available boost and additional power for the subject engine 14. With installation instructions being followed, replacement exhaust manifold 10 may be designed to make acceptable clearance to all under-hood obstacles and allow turbocharger 12 to function for its intended purpose. The development of replacement exhaust manifold 10 may allow self-contained bolt-on product 38 for adding turbocharger 12 to these particular engine applications, not previously available for these chassis. Replacement exhaust manifold 10 may thereby eliminate the previous need to replace engine 14, replace the "doghouse"/engine cover and/or lift the truck body in order for the user to add turbocharger 12.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A replacement exhaust manifold for retrofitting a turbocharger to an engine comprising:

a central channel body having a first end and a second end;

an exhaust connection connected to the first end of the central channel body, the exhaust connection is configured to be attached to an exhaust system for the engine, the exhaust connection is connected to the first end of the central channel body via an S-shaped connection configured to lower the exhaust connection below the central channel body;

a turbo connection connected to the second end of the central channel body, the turbo connection is configured to be attached to the turbocharger, the turbo connection including an upward curved connection at the second end of the central channel body; and a plurality of exhaust ports along the central channel body, each of the exhaust ports are configured to be attached to a corresponding exhaust outlet port on a cylinder head of the engine, each of the exhaust ports along the central channel body are positioned between the exhaust connection connected on the first end of the central channel body and the turbo connection connected on the second end of the central channel body, wherein an exhaust end port of one of the plurality of exhaust ports is positioned along the S-shaped connection of the exhaust connection;

wherein, the replacement exhaust manifold is configured to be attached to the engine for retrofitting the turbocharger to the engine; and wherein the engine is a 6.2 non-turbo diesel engine or a 6.5 non-turbo diesel engine of a civilian or military high mobility multipurpose wheeled vehicle, and the replacement exhaust manifold is configured to be mounted on a right side cylinder head of the 6.2 non-turbo diesel engine or the 6.5 non-turbo diesel engine, wherein the replacement exhaust manifold is configured to work within tight confines of under-hood area on a vehicle housing the engine, where the replacement exhaust manifold is designed to make acceptable clearance to all under-hood obstacles and allow the retrofitted turbocharger to function on such civilian or military high mobility multipurpose wheeled vehicle; and wherein the plurality of exhaust ports including four exhaust ports, one exhaust port for each of four corresponding exhaust outlet ports of the right-hand side cylinder head of a 6.2 non-turbo diesel engine or a 6.5 non-turbo diesel engine.

2. The replacement exhaust manifold of claim 1, the replacement exhaust manifold is configured to replace an original equipment exhaust manifold for retrofitting the turbocharger to the engine.

3. The replacement exhaust manifold of claim 1, wherein the replacement exhaust manifold is configured to facilitate collection of exhaust gases of the engine and route such exhaust gases through the turbo connection, thereby resulting in an increase in power from the engine via the retrofitted turbocharger, wherein the replacement exhaust manifold receives incoming exhaust gases and channels them to the retrofitted turbocharger, thereby resulting in available boost and additional power for the engine.

4. The replacement exhaust manifold of claim 1, wherein the replacement exhaust manifold is configured to allow a self-contained bolt-on product to facilitate retrofitting the turbocharger to the engine.

5. The replacement exhaust manifold of claim 1, wherein the replacement exhaust manifold is configured to allow the engine to be retrofitted with the turbocharger without the need to replace the engine, replace an engine cover, lift a truck body in order for to retrofit the turbocharger to the engine.

6. The replacement exhaust manifold of claim 1, wherein the replacement exhaust manifold is made of a cast ductile iron.

7. The replacement exhaust manifold of claim 1, wherein the exhaust connection is a triangular flange configured to attach to the exhaust system of the engine.

8. The replacement exhaust manifold of claim 7, wherein the exhaust connection including a circular channel and three exhaust holes through the triangular flange at each triangle corner of the triangular flange, whereby the triangular flange are configured to be bolted to the exhaust system via three exhaust bolts where the circular channel is configured to be sealed to the exhaust system.

9. The replacement exhaust manifold of claim 1, wherein each of the exhaust ports including a diamond shaped flange configured to attach to one of a plurality of corresponding exhaust outlet ports of a right-hand side cylinder head of the engine.

10. The replacement exhaust manifold of claim 1, wherein each of the exhaust ports including a curved rectangular channel protruding from the central channel body and terminating with the diamond shaped flange, and each of the diamond shaped flanges including a first notch at one diamond corner and a second notch at an opposite diamond corner, whereby each of the diamond shaped flanges are configured to be bolted to one of the corresponding exhaust outlet ports of the right-hand side cylinder head of the engine via two cylinder bolts through the first notch and the second notch, where each of the rectangular channels of the exhaust ports are sealed to one of the corresponding exhaust outlet ports of the right-hand side cylinder head of the engine.

11. The replacement exhaust manifold of claim 10 further comprising a plurality of indentions on the central channel body, the plurality of indentions are positioned between each adjacent exhaust port, wherein the plurality of indentions are configured for receiving protrusions from the engine for installing the replacement exhaust manifold on the engine.

12. The replacement exhaust manifold of claim 1, wherein the turbo connection is a rectangular flange configured to attach to the retrofitted turbocharger of the engine.

13. The replacement exhaust manifold of claim 12, wherein the upward curved connection terminating with the rectangular flange, the rectangular flange having four turbo holes therethrough at each rectangle corner of the rectangular flange, whereby the rectangular flange is configured to be bolted to the turbocharger via four turbo bolts where the upward curved connection is sealed to the turbocharger.

14. The replacement exhaust manifold of claim 12, wherein the rectangular flange is an industry standard T-3 turbo mounting flange, whereby the replacement exhaust manifold is configured to allow the turbocharger with a T-3 mounting flange to be retrofitted to the engine, whereby the replacement exhaust manifold is configured to gather exhaust gasses from both banks of the cylinder heads of the engine and efficiently route such exhaust gasses through the T-3 mounting flange with a minimum reduction in velocity.

15. The replacement exhaust manifold of claim 1, wherein the upward curved connection of the turbo connection including an outward curved portion and an upward curved portion at the second end of the central channel body.

16. A retrofitted engine comprising:

a replacement exhaust manifold for retrofitting a turbocharger to the retrofitted engine, the replacement exhaust manifold comprising:

a central channel body having a first end and a second end;

an exhaust connection connected to the first end of the central channel body, the exhaust connection is configured to be attached to an exhaust system for the engine, the exhaust connection is connected to the first end of the central channel body via an S-shaped connection configured to lower the exhaust connection below the central channel body;

a turbo connection connected to the second end of the central channel body, the turbo connection is configured to be attached to the turbocharger, the turbo connection including an upward curved connection at the second end of the central channel body; and a plurality of exhaust ports along the central channel body, each of the exhaust ports are configured to be attached to a corresponding exhaust outlet port on a cylinder head of the engine, each of the exhaust ports along the central channel body are positioned between the exhaust connection connected on the first end of the central channel body and the turbo connection connected on the second end of the central channel body;

wherein, the replacement exhaust manifold is configured to be attached to the engine for retrofitting the turbocharger to the engine; wherein the engine is a 6.2 non-turbo diesel engine or a 6.5 non-turbo diesel engine of a civilian or military high mobility multipurpose wheeled vehicle, and the replacement exhaust manifold is configured to be mounted on a right side cylinder head of the 6.2 non-turbo diesel engine or the 6.5 non-turbo diesel engine, wherein the replacement exhaust manifold is configured to work within tight confines of under-hood area on a vehicle housing the engine, where the replacement exhaust manifold is designed to make acceptable clearance to all under-hood obstacles and allow the retrofitted turbocharger to function on such civilian or military high mobility multipurpose wheeled vehicle; and wherein the plurality of exhaust ports including four exhaust ports, one exhaust port for each of four corresponding exhaust outlet ports of the right-hand side cylinder head of a 6.2 non-turbo diesel engine or a 6.5 non-turbo diesel engine.

17. The retrofitted engine of claim 16, wherein the upward curved connection of the turbo connection including an outward curved portion and an upward curved portion at the second end of the central channel body.

18. A method of retrofitting a turbocharger to an engine comprising:

providing a replacement exhaust manifold for the engine comprising:

a central channel body having a first end and a second end;

an exhaust connection connected to the first end of the central channel body, the exhaust connection is configured to be attached to an exhaust system for the engine, the exhaust connection is connected to the first end of the central channel body via an S-shaped connection configured to lower the exhaust connection below the central channel body;

a turbo connection connected to the second end of the central channel body, the turbo connection is configured to be attached to the turbocharger, the turbo connection including an upward curved connection at the second end of the central channel body; and a plurality of exhaust ports along the central channel body, each of the exhaust ports are configured to be attached to a cylinder head of the engine, each of the exhaust ports along the central channel body are positioned between the exhaust connection connected on the first end of the central channel body and the turbo connection connected on the second end of the central channel body;

wherein, the replacement exhaust manifold is configured to be attached to the engine for retrofitting the turbocharger to the engine;

wherein the engine is a 6.2 non-turbo diesel engine or a 6.5 non-turbo diesel engine of a civilian or military high mobility multipurpose wheeled vehicle, and the replacement exhaust manifold is configured to be mounted on a right side cylinder head of the 6.2 non-turbo diesel engine or the 6.5 non-turbo diesel engine, wherein the replacement exhaust manifold is configured to work within tight confines of under-hood area on a vehicle housing the engine, where the replacement exhaust manifold is designed to make acceptable clearance to all under-hood obstacles and allow the retrofitted turbocharger to function on such civilian or military high mobility multipurpose wheeled vehicle; and wherein the plurality of exhaust ports including four exhaust ports, one exhaust port for each of four corresponding exhaust outlet ports of the right-hand side cylinder head of a 6.2 non-turbo diesel engine or a 6.5 non-turbo diesel engine removing an original equipment exhaust manifold from the engine;

installing the replacement exhaust manifold on the engine including;

bolting each of the plurality of exhaust ports to one of the cylinder heads of the engine via diamond shape flanges; and bolting the exhaust connection to the exhaust system of a vehicle; and retrofitting the turbocharger onto the engine by bolting the turbocharger to the turbo connection via a rectangular flange or a standard T-3 turbo mounting flange of the installed replacement exhaust manifold on the engine.

19. The retrofitted engine of claim 18, wherein the upward curved connection of the turbo connection including an outward curved portion and an upward curved portion at the second end of the central channel body.

* * * * *